United States Patent [19]

Divisek et al.

[11] 4,300,993

[45] Nov. 17, 1981

[54] METHOD OF MAKING A POROUS NICKEL ELECTRODE FOR ALKALINE ELECTROLYSIS PROCESSES AND RESULTING PRODUCT

[75] Inventors: Jiri Divisek; Jürgen Mergel, both of Jülich, Fed. Rep. of Germany

[73] Assignee: Kernforschungsanlage Jülich Gesellschaft mit Beschrankter Haftung, Jülich, Fed. Rep. of Germany

[21] Appl. No.: 134,756

[22] Filed: Mar. 28, 1980

[30] Foreign Application Priority Data

Apr. 7, 1979 [DE] Fed. Rep. of Germany ..... 2914094

[51] Int. Cl.[3] ..... C25B 11/06; C25D 3/56; C25D 5/48

[52] U.S. Cl. ..... 204/290 R; 204/35 R; 204/43 R; 204/43 Z; 204/293; 204/43 T

[58] Field of Search ..... 204/35 N, 43 Z, 43 N, 204/290 R, 293, 35 R, 43 R

[56] References Cited

U.S. PATENT DOCUMENTS 3,272,728 9/1966 Hahndorff et al. ..... 204/35 R
3,948,684 4/1976 Armstrong ..... 427/115
4,170,536 10/1979 Kawasaki ..... 204/290 R

FOREIGN PATENT DOCUMENTS 674411 11/1963 Canada ..... 204/293
1471644 12/1968 Fed. Rep. of Germany .
1546717 6/1974 Fed. Rep. of Germany .
2449603 5/1976 Fed. Rep. of Germany .
2737041 3/1978 Fed. Rep. of Germany .
2832184 2/1979 Fed. Rep. of Germany .

*Primary Examiner*—F. Edmundson
*Attorney, Agent, or Firm*—Frishauf, Holtz, Goodman & Woodward

[57] ABSTRACT

On a sheet steel carrier a suspension containing a binder and nickel powder or a powder containing a nickel alloy in a volatile suspension medium is applied, with or without an additional pore-forming material, and the sintered to produce a porous sintered layer. Alternatively, this sintered layer can be obtained by depositing and consolidating the powdered mixture on the carrier with the aid of a plasma gun. A nickel/zinc alloy is then precipitated electrolytically on the sintered material thus produced and, finally, the zinc is dissolved out by dipping in lye. The carrier may be of metal and particularly a wire lattice of nickel or iron. It may also be a solid electrolyte membrane, such as a disc of $\beta$-$Al_2O_3$.

13 Claims, 1 Drawing Figure

Figure 1:
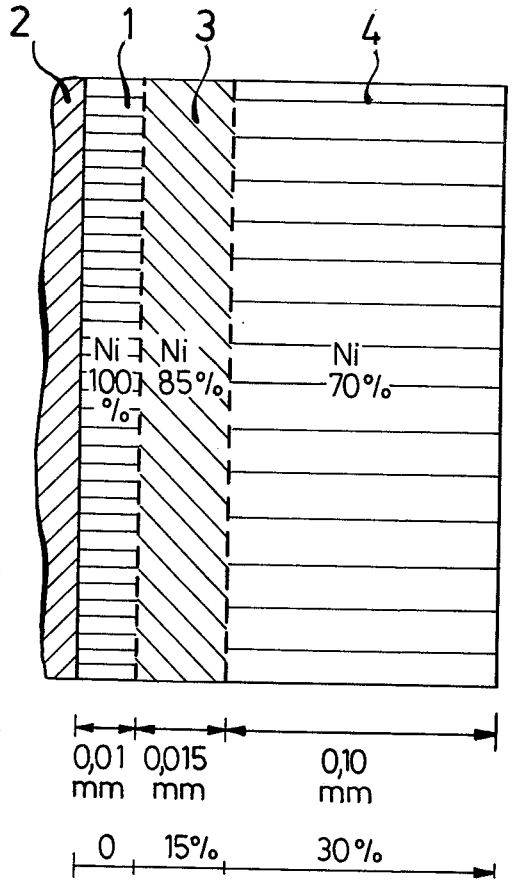

METHOD OF MAKING A POROUS NICKEL ELECTRODE FOR ALKALINE ELECTROLYSIS PROCESSES AND RESULTING PRODUCT

This invention relates to nickel electrodes of porous surface for alkaline electrolyses in aqueous or molten media and a method of producing the same.

Various applications of alkaline electrolyses are found in industrial practice, such as, for example, the production of hydrogen and oxygen, or the electrochemical production of chlorine or hydroxides. In these processes, the cell voltage necessary for the electrolysis should be kept as low as possible for reasons of economy. The raising of the operating temperature has been found, particularly in recent times, as one of the best ways of lowering the cell voltage. Hence, fusion electrolysis in alkaline condition appears to be particularly advantageous for the production of hydrogen on a large scale by the decomposition of water. For such a molten fluid electrolysis of water, nickel or graphite is used as the electrode material in a process proposed by the assignee of the present application, as described in German published patent application No. P 27 56 569.1.

The use of nickel electrodes is also described, for example, at pp. 123–128 of "Angewandte Elektrochemie" by A. Schmidt (Verlag Chemie 1976). According to that disclosure, it is also known to reduce the overvoltages at the electrode by increasing the electrode surface, for which purpose mechanical treatments or chemical roughening processes are recommended, as for example, among others, the dissolving out of zinc or aluminum from an electrode surface containing that metal as an alloy addition.

In practice, it appears that electrodes obtainable by the dissolving out of zinc from an electrolytically precipitated nickel-zinc alloy are not in any way satisfactory. Roughened electrodes obtained by the dissolving out of aluminum of an aluminum containing nickel alloy, however, behave very well; but they are producible only with considerable expense (by melting of nickel-aluminum alloys). Processes are also known for the production of porous electrodes starting with metal powder that is mixed with a binder and a filler, with or without a suspension liquid, and then is pressed into molded bodies and sintered (see DE-OS No. 1 471 644) with or without the use of a carrier such as a tantalum grid or glass fibers. According to another process, a suspension of metal powder and binder is applied to a carrier and is sintered under low pressure (see German Pat. No. 1 546 717). Finally, according to DE-OS No. 2 737 041, an electrode is produced by painting on a nickel powder paste on a conductor of embossed metal and then drying and sintering.

The sintered electrodes thus obtainable on the one hand show no optimum properties upon being introduced into the electrolysis and, on the other hand, their service life is only limited.

SUMMARY OF THE PRESENT INVENTION

The object of the invention is, accordingly, to provide an electrode with improved properties, as well as a suitable process for producing such electrodes.

Briefly, the method of the invention for producing nickel electrodes of porous surface starts with a suspension of a binder and of nickel powder or a powder containing a nickel alloy in a volatile suspension medium, which may have added to it pore-forming material, a porous sintering layer is applied to a carrier and then, on the sintered product thus obtained a nickel/zinc alloy is precipitated electrolytically, from which the zinc is thereafter dissolved out in lye. The carrier in such cases can be a metal carrier as for example sheet metal or a metal lattice, particularly a nickel or iron lattice or, on the other hand, a solid electrolyte membrane, such as particularly a disc of $\beta$-$Al_2O_3$.

The porous sintering layer formed on the carrier can be obtained by applying the suspension, drying the applied layer and sintering the entire device. On the other hand, the powder mass can be applied to the carrier by a plasma gun, while at the same time a sufficient coalescence of the granular material is obtained, without any necessity of heating the carrier itself to the sintering temperature. This last type of method has been found to be suitable particularly for the manufacture of porous electrodes on a $\beta$-$Al_2O_3$ carrier.

Electrodes of large surface with well-suited electrolysis behavior can simply and cheaply be produced by the process of the invention. The porous structure provided by granular material and pressure-less sintering treatment is apparently further consolidated by the supplementary step of electrolytic coating with a nickel/zinc alloy, followed by dissolving out of zinc by treatment with lye, thus obtaining at the same time a still more extensive surface roughness. The consistency and activity of such electrodes is surprisingly good.

The sintering and activation process according to the invention offers particular advantages for the production of layer electrodes on the surface of solid electrolyte membranes (such as are usable for the fusion electrolysis of water), because according to the invention an adhering bond is obtained between the membrane and the electrode layer which helps to avoid the formation of intermediate gas layers at the membrane-electrode boundary layer during water electrolysis.

THE DRAWING

The gases produced by electrolysis (hydrogen or oxygen as the case may be) reach the exterior of the electrode much more evidently without difficulty through the open-pore material and are given off at the electrode surface, while at the same time a sufficient bonding of material between the electrode carrier and the electrolyte membrane prevents accumulation of gas in this region.

According to the process of the invention, a nickel or nickel alloy containing powder suspension is put onto the carrier which may for example be a nickel lattice, with a surface density corresponding approximately to 10 to 100 mg Ni/cm$^2$, more particularly about 20 to 60 mg Ni/cm$^2$ and preferably about 40 mg Ni/cm$^2$. For the nickel powder, there can be used for example carbonyl nickel powder with grain sizes in the region of about 2 to 3 $\mu$m.

As the binder rubber is particularly useful, preferably natural rubber, which is conveniently used for the preparation of the suspension as a solution (e.g. 0.5%) in a mixture of toluene and xylene. The solid phase of the suspension can, along with the metal powder, also contain a certain proportion of pore-forming materials, for which purpose preferably ammonium carbonate can be added, the proportion of which (with reference to the metal powder) can lie in the region of about 10 to 30%.

The sintering treatment is preferably carried out in hydrogen with use of the usual calcination conditions, as for example temperatures in the region of 800° C. and calcining periods of 10 to 100 minutes, with the heating up and the cooling carried out for safety reasons in an argon atmosphere.

The sintered body is activated by electrolytic precipitation of a nickel/zinc alloy in a layer thickness lying in the region of a few tenths of millimeters, followed by dissolving out the zinc with lye, a treatment in which relatively concentrated lye is preferably used at temperatures above 50° C. In particular, by gradual increase of the zinc content in the layer as it is formed, care can be taken to assure that the inner layers which are rich in nickel operate to promote bonding, whereas the increase of the zinc content towards the surface produces a porosity correspondingly increasing outwards. The latter feature favors leading out and discharging the gases produced by electrolysis.

BRIEF DESCRIPTON OF THE DRAWING

The single FIGURE of the drawing is a diagram showing layers built up on a sheet metal carrier at the left, the thickness of the layers and their porosity being indicated on scales at the bottom.

The structural construction of an electrode with a bond-producing sintered layer 1 on a sheet steel carrier 2 is illustrated diagrammatically in the single FIGURE of the drawing. As shown by the scale at the bottom, the porosity increases towards the surface. As a simplification, only two different porosities are shown for the activating layer 3,4 and a sharp boundary is shown between the differently shaded individual zones, although particularly in the interior region, a considerable interpenetration is present. The illustrated thickness ratios of the zones among each other can of course vary greatly from this simplified representation, particularly, the layer 1 could be much greater in comparison with the activating layers 3,4 than shown, as this layer is consolidated and penetrated by galvanic precipitation.

There are given below illustrated examples for the practice of the invention, with reference to which examples the invention can be still better understood.

EXAMPLE 1

A nickel lattice made of wire having a diameter of 0.1 mm with a mesh width of 0.25 mm is spot welded to a circular sheet nickel disc having a diameter of 2 cm. A nickel powder suspension containing a binder was painted on the nickel lattice. The solid phase of the suspension had the composition of practically 80% carbonyl nickel powder of 2.2 to 3 μm grain size and 20% of solid $(NH_4)_2CO_3$.

Natural rubber in the form of a 0.01% solution in a mixture of toluene and xylene served as the binder. After separation of the solvent, the electrode was heated in a calcination vessel in an argon atmosphere up to 800° C. and after reaching this temperature was flushed for 30 minutes with hydrogen. Thereafter, the electrode was again cooled in argon.

In an analogous fashion, sintered bodies were produced starting from a carbonyl nickel/Raney nickel mixture in the weight ratio of 2:1.

The sintered body was subjected to an activation treatment in the following manner: on each sintered body, a zinc-nickel alloy was precipitated cathodically, with stirring, to a layer thickness of 0.1 mm at 70° C. In this last step, a 0.5 m $NiCl_2$ and 0.1 m $ZnCl_2$ borate buffer solution having the pH of 2.2 served as electrolyte and the current density was gradually increased by raising the negative potential of the electrode according to the following program: the percentage values relate to the charge quantity used for precipitation of the layer as a whole of the order of 600 Cb/cm$^2$):

| | |
|---|---|
| 0–5% at | −750 mV |
| 5–15% at | −800 mV |
| 15–25% at | −820 mV |
| 25–100% at | −830 mV |

As a result, there was obtained an alloy precipitation having a composition varying from about 90 to 100% nickel to about 70% nickel at the surface.

The body thus treated was then "activated" by dipping in 30% KOH solution and then used for aqueous electrolysis in 30% KOH solution at 100° C. under atmospheric pressure. With an electrode spacing of 5 mm with use of a synthetic resin diaphragm for separating the gas products formed (hydrogen and oxygen) the following cell voltage values were typically obtained at the two measuring probes:

| | 40 mA/cm$^2$ | 100 mA/cm$^2$ | 200 mA/cm$^2$ | 300 mA/cm$^2$ |
|---|---|---|---|---|
| 80° C.: | 147 | 1.53 | 1.60 | 1.64 |
| 100° C.: | 1.46 | 1.51 | 1.55 | 1.60 |

These values are among the best obtainable.

EXAMPLE 2

The grading of the composition of a zinc/nickel alloy can be very easily obtained by the level of potential of the electrode (or its corresponding current density, which is equivalent thereto). In identical electrolytes and at the same temperature as in Example 1, the electrode was polarized with three different potentials. The following alloys were thereby obtained:

| Electrode potential vs. saturated calomel electrode: | −800 mV | −830 mV | −850 mV |
|---|---|---|---|
| % Ni in the alloy: | 86% | 73% | 67% |

Although the invention has been described with reference to particular specific examples, it will be understood that variations and modifications are possible within the inventive concept.

We claim:

1. A method of manufacturing nickel electrode with porous surfaces for use in alkaline electrolysis, even for production of hydrogen by fusion electrolysis, comprising the steps of:

producing a porous sintered layer on a carrier body starting from a powder containing a powdered metal selected from the group consisting of nickel and alloys of nickel;

depositing a nickel/zinc alloy electrolytically on said sintered layer, and dissolving the zinc out of the nickel/zinc alloy by dipping the carrier body and the layers thereon into a lye solution, in order to produce porosity in the electrolytically deposited material.

2. A method as defined in claim 1, in which the step of producing said sintered layer begins by preparation of a suspension in a volatile solvent of said powder, a binder and a material that produces pores by gasliberating thermal decomposition, then depositing the solid material of said suspension on said carrier body and then sintering the residue after evaporation of the solvent.

3. A method as defined in claim 1, in which said carrier body is a metallic body.

4. A method as defined in claim 3, in which said metallic body is a metallic lattice.

5. A method as defined in claim 4, in which said metallic lattice is made of a metal selected from the group consisting of nickel, iron and nickel-base and iron-base alloys.

6. A method as defined in claim 1, in which said carrier body is a disc or plate of a solid electrolyte oxide membrane.

7. A method as defined in claim 6, in which said solid electrolyte oxide is $\beta$-$Al_2O_3$.

8. A method as defined in claim 2, in which the deposit of said solids of said suspension has a surface density of from 20 to 60 mg/cm$^2$.

9. A method as defined in claim 1, in which said powdered metal consists of pure carbonyl nickel.

10. A method as defined in claim 1, in which said powdered metal consists of a mixture of carbonyl nickel and a powder of a nickel alloy selected from the group consisting of nickel-aluminum and nickel-zinc alloys.

11. A method as defined in claim 1, in which said nickel/zinc alloy deposit is precipitated from a solution of nickel and zinc salts selected from the group consisting of chlorides, sulfates, phosphates and nitrates in such a ratio of zinc to nickel that said deposit has a nickel content in the region between 40 and 95% by weight.

12. A method as defined in claim 11, in which during electrolytic deposition the current density is gradually increased, whereby the ratio of zinc to nickel thereby deposited gradually increases.

13. A nickel electrode with a porous surface for alkaline electrolysis processes obtained by a process according to claim 1 and comprising a carrier body (2), a nickel-containing metal powder sintered mass (1) on said carrier body produced by deposition thereon from a suspension, and an activation layer superposed on said sintered mass produced by electrolytic deposition of nickel and zinc on said sintered mass followed by dissolving out the zinc content from said activation layer as originally deposited.

* * * * *